US006786621B2

(12) United States Patent
Sviland

(10) Patent No.: US 6,786,621 B2
(45) Date of Patent: Sep. 7, 2004

(54) DO-IT-YOURSELF LAMPSHADE KIT

(75) Inventor: Elen Sviland, Jersey City, NJ (US)

(73) Assignee: Mode Interiors LLC, Jersey City, NJ (US)

( * ) Notice: Subject to any disclaimer, the term of this patent is extended or adjusted under 35 U.S.C. 154(b) by 173 days.

(21) Appl. No.: 10/308,728

(22) Filed: Dec. 3, 2002

(65) Prior Publication Data

US 2003/0081418 A1 May 1, 2003

Related U.S. Application Data

(63) Continuation-in-part of application No. 09/652,338, filed on Aug. 31, 2000, now abandoned.

(51) Int. Cl.[7] ..... F21V 11/00; F21V 1/36
(52) U.S. Cl. ..... 362/351; 362/237; 362/352
(58) Field of Search ..... 362/351, 356, 362/357, 360, 355, 352, 237, 246

(56) References Cited

U.S. PATENT DOCUMENTS 1,309,263 A * 7/1919 Spellman
1,477,991 A * 12/1923 Baker
1,813,492 A * 7/1931 Goodloe ..... 362/360
1,863,767 A * 6/1932 Shapiro ..... 362/360
4,268,896 A * 5/1981 Mann ..... 362/311
4,418,379 A * 11/1983 De Marsh ..... 362/282
5,211,474 A * 5/1993 Leitner et al. ..... 362/351
5,685,635 A * 11/1997 Barthelmess ..... 362/249
6,190,024 B1 * 2/2001 Hackett et al. ..... 362/357

* cited by examiner

*Primary Examiner*—Laura K. Tso
(74) *Attorney, Agent, or Firm*—Bradley N. Ruben

(57) ABSTRACT

Lamp shades are provided in the form of one or more panels made of a flexible, self-supporting material. All of the panels have side edges with a plurality of holes, and when the side edges are overlapped to register the holes a fastener can be inserted (and preferably later removed) from the registered holes. A table lamp or pendant lamp includes a plurality of panels (at least two) and a hanger by which the lamp is supported on a stand or receptacle. String light lamps can be provided with a single shade for each lamp where the single shade is bent or curved around, over the lamp, to connect the side edges to each other.

24 Claims, 5 Drawing Sheets

FIG. 1

DO-IT-YOURSELF LAMPSHADE KIT

This application is a continuation-in-part of application Ser. No. 09/652,338, filed Aug. 31, 2000, now abandoned, the disclosure of which is incorporated herein by reference.

BACKGROUND OF THE INVENTION

1. Field of the Invention

This invention relates to lamp shades, and especially a method for making and altering lamp shades that can be practiced in the home.

2. The State of the Art

Ever since people starting using small light sources, whether from electric bulbs, from small gas mantles, or oil lamps, there has been a desire to shade the light to create a more balanced illumination or just for decoration.

There have been various types of shades that are relatively easy to assemble. Read, Jr., in U.S. Pat. No. 103,928, describes a paper or cardboard shade secured in a conical form with wire paper clip-like fasteners. Spellman, in U.S. Pat. No. 1,309,263, and Baker, in U.S. Pat. No. 1,477,991, describe cardboard or paper lamp-shades that can be formed into a conical shape and held with a tab and slot configuration. Laws, in U.S. Pat. No. 86,987, describes a lamp shade having similar tabs and slots but made with sheet metal. Huang, in U.S. Pat. No. 4,747,031, describes a lamp shade held in a conical form by a wire fastener akin to those used in spiral-bound notebooks.

Other lamp shades use a plurality of panels. For example, Heise, in U.S. Pat. No. 3;582,643, Mann, in U.S. Pat. No. 4,278,896, and Hagelthom, in U.S. Pat. No. 4,176,529, each discloses a lamp shade made from a plurality of panels, optionally where a panel has a design on it: Huang, in U.S. Pat. No. 4,688,155, discloses multiple panels secured with wire fastener akin to those used in spiral-bound notebooks. Goodloe, in U.S. Pat. No. 1,813,492, discloses the use of wood panels. Shapiro, in U.S. Pat. No. 1,863,767, discloses the use of parchment paper to cast light both up and down. Leitner et al., in U.S. Pat. No. 5,211,474, discloses a do-it-yourself lamp shade kit with a pattern cutout for fabric. Hackett et al., in U.S. Pat. No. 6,190,024, discloses a method for securing a lampshade to a frame.

The art is devoid of a lamp shade which can not only be made from a kit, but which can be changed after it has been used, and changed in an easily-implemented manner so that even children can have fun creating and using new lamp shades.

SUMMARY AND OBJECTS Of THE INVENTION

In light of the foregoing, one object of this invention is to provide a lamp shade kit that can be easily assembled. Another object is to provide such a kit where a pattern or design can be provided for the shade, and especially where the pattern or design can be changed when desired, thereby necessitating that the shade be easily disassembled and reassembled. Still another object is to provide such a kit wherein the pattern or design can be produced on a personal computer, the pattern or design printed out and then applied to the panels, and the same done as desired.

Thus, in one aspect this invention provides a lamp shade comprising a plurality of panels which, when joined, provide a conical surface having the top and bottom opened, each of the panels have a top and a bottom edge and opposing side edges, each of the side edges having a plurality of holes, adjacent panels being held together by overlapping their corresponding side edges effective to register the holes of one edge with the holes of the other edge, and inserting separately into each of the plurality of the registered holes a removable fastener. In a preferred embodiment, the invention further comprises a sheet of adhesive paper having a pattern or design thereon adhered to at least one of the panels and preferably to all. In another embodiment the invention comprises modifying the lamp shade so created by printing out a new pattern or design, disassembling the assembled lamp shade, applying the new pattern design to at least one of the panels, and then reassembling the lamp shade.

DETAILED DESCRIPTION OF PREFERRED EMBODIMENTS

Figure 1:
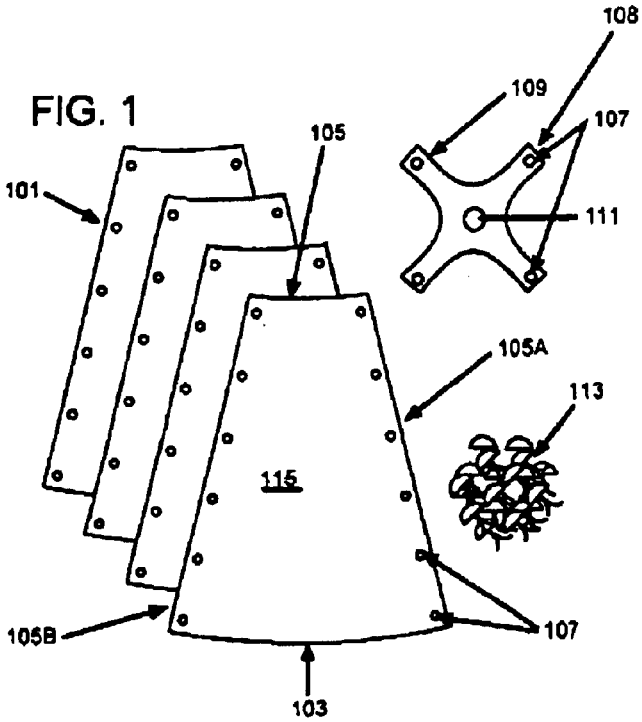
FIG. 1 depicts the partial contents of a kit sufficient to make a basic lamp shade.
Figure 2:
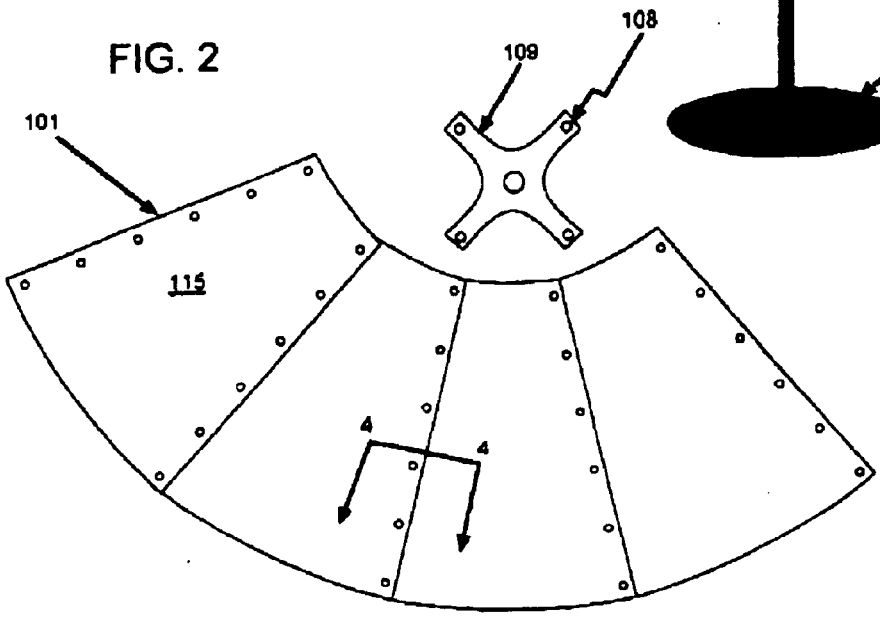
FIG. 2 depicts a partially assembled lamp shade.
Figure 5:
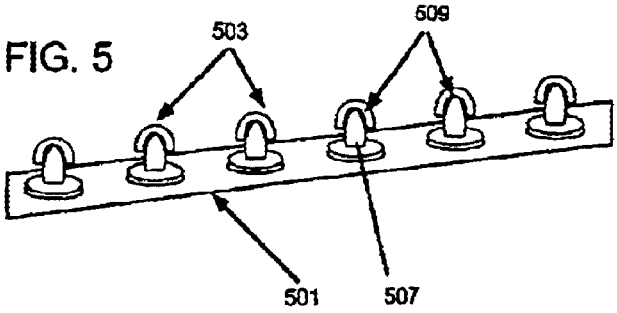
FIG. 5 is a perspective view of a strip of fasteners.

FIG. 1 depicts the partial contents of a kit for making the instant lamp shade. The kit includes a plurality of panels 101, preferably four, which when assembled form the surface of a cone. Each of the panels includes a bottom edge 103, a top edge 105, and opposing side edges 105*a*/*b*. Preferably, all of the panels are identical. Along each of the opposing aide edges are a series of holes 107 positioned so that when adjacent panels are overlapped (as shown in FIG. 2). the holes in one panel register with the holes in the adjacent, overlapping panel. The panels are made of a transparent or translucent flexible plastic so that light is transmitted through the surface 115 of the panel, although a panel can also be made of metal, paperboard, or the like which can be bent or curved to form a frustoconical lampshade form (or other curved geometric form), which can be packed flat, and which is self-supporting in such form without a frame. Preferred materials for the panels are heat resistant polymers such as vinyl, preferably rigid vinyl (but flexible enough to band), polycarbonates, polystyrene, and the like, as well as any polymer, optionally plasticized, that is sufficiently flexible to be bent around to form the lamp shade, and so long as the material as sufficiently heat resistant to the bulb or lamp that the plastic is no in danger of melting or burning; additional preferred materials are metal sheet such as aluminum and brass. The kit also includes a hanger 108 which is joined to each of the panels by arms having similar holes 107, and which supports the conical portion of the shade through a center hole 111 or mounting ring as conventional shades are supported or mounted on a lamp. The kit also provides a multiplicity of individual fasteners 113 (preferably packaged together), such as conventional prong fasteners sold in office supply stores, and which can be of silver- or gold-colored metal, or they may be made of plastic and have button top connected to a stem made of a spring-snap or spring-pawl that is releasable so that the fastener can be removed and reused. Alternatively, the fasteners can be provided in a strip as shown in FIG. 5, wherein the strip has a base 501 on which are secured a plurality of fasteners 503, each of which contains a pedestal 507 having one end affixed to the base and one or more prongs 509 extending from the other end of the pedestal.

The kit also preferably includes, although not shown, a sheet of printable labels, each of the labels having the geometry of a panel. These sheets are akin to standard sheets of labels and are sold by such companies as Avery Dennison Corporation, Pasedena, Calif., and can also be custom made, such as by LabelWorks (division of Taylor Corporation, Mankato, Minn.; www.labelworks.com), Nev's Ink, Inc. (Waukesha, Wis.; www.nevsink.com), and many others. These sheets typically have adhesive-coated paper on top of a release layer, the paper being precut or pre-scored in a desired shape, and being supported on a backing. In this case, the pre-cut desire shape preferably conforms to the geometry of the panels shown in the figures, and most preferably extends out to the opposing sides. In such an embodiment, the label preferably also has a plurality of holes that correspond with those on the opposing sides of the panel, although the prong-type fasteners are designed to punch through paper and so the labels need not have pre-punched or pre-scored holes. Also optionally included in the kit is software that facilitates designing and printing such labels on a personal computer with a printer or similar output device. Of course, the kit may come with one or more pre-printed sheets having labels that can be adhered to one or more of the panels.

Alternatively, the kit can have the lampshade pattern printed directly on the plastic, metal, or paperboard shade.

In yet another alternative embodiment, the purchaser of the lampshade kit can access a website to design and/or download a new lampshade design. The user can be provided with communications software or can access the specific website using a standard internet service provider and conventional browser software. From the website, the user can pick a pre-made design or can use software available on the site to create a new lampshade design on-line. Thereafter, the user can either download the newly created design to print on a local printer, or the user can have the design delivered by conventional means. In the case that the designs are delivered, the design(s) created on the website are printed onto labels and/or onto new lampshade panels (paper, plastic, and/or metal) and then sent to the user by conventional delivery methods (mail, courier).

In operation, the user takes a printed sheet of labels, either preprinted or created on a- personal computer and printed on a blank sheet of labels, and affixes the label(s) to as many of the panels as desired; and/or the user selects panels having designs pre-printed thereon. Preferably the panels are plastic and, if labels are used, one label is adhered to the outside (away from the lamp bulb) of each panel. The panels could, instead, be made of paperboard, in which case a new set of blank panels is required each time the lamp shade is redesigned because the adhesive commonly used for sheets of labels typically is not releasable from paper or paperboard. Once the labels (or decals) have been adhered to the panels, a pair of panels is placed in overlapping relationship with the holes of their side edges registered, and then a sufficient number of fasteners are used to secure the panels adjacently. Plastic fasteners are preferably transparent, optionally, colored. Finally, the hanger 108 is attached at the top edge 105 where overlapping registered holes 107 from two adjacent panels are located. This arrangement, shown with a partially assembled shade, is depicted in FIG. 2.

Figure 9:
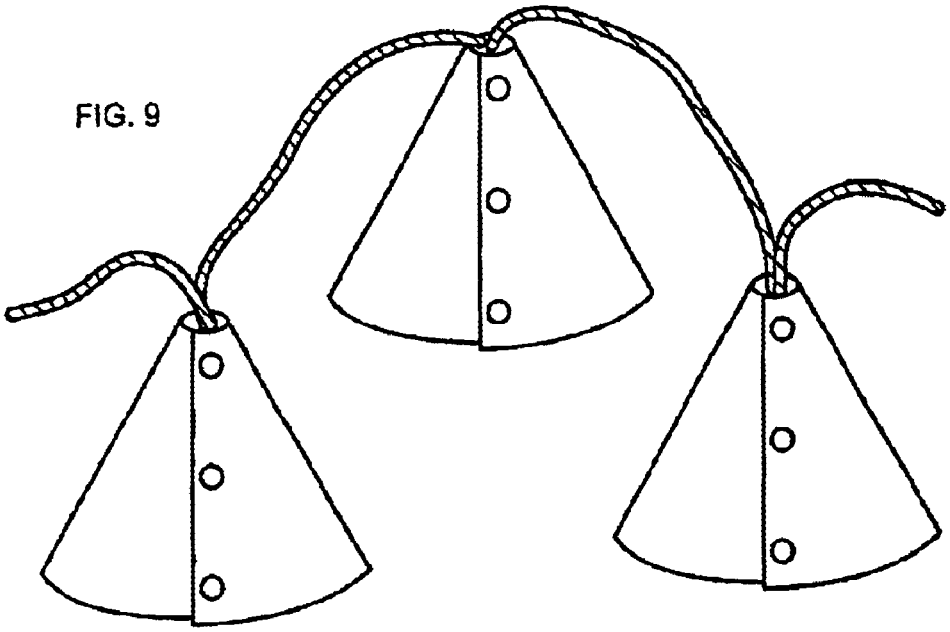
FIG. 9 depicts a series of string lights using the panels of FIG. 8.
Figure 10:
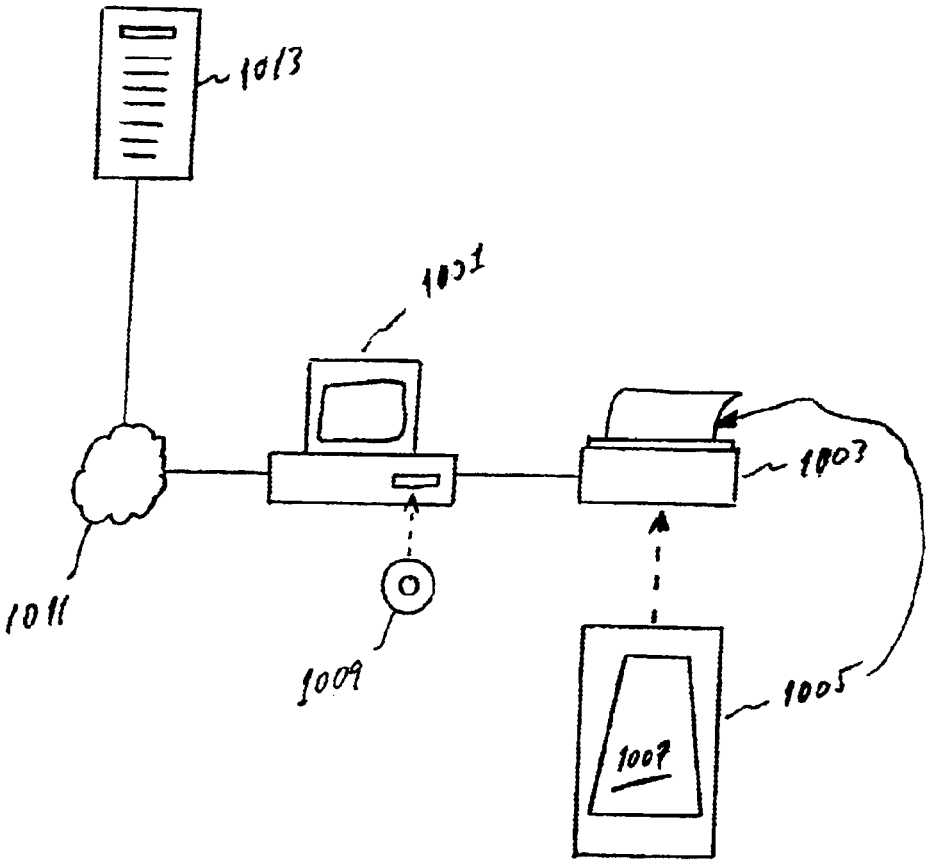
FIG. 10 depicts an idealized view of printing panels via a computer.

For example, as shown in FIG. 9, a user's personal computer 1001 connected to a printer 1003 can be used to print labels for changing the designs on the panels. A sheet 1005 having a label 1007 in the shape of the panel of the lamp shade is fed into the printer. The user can use software (such as provided on a cd-rom 1009) to create and print the label locally. Alternatively, the user can use a network 1011 (such as the Internet) to access a remote computer 1013 (such as or via a website) to design and print labels on their own printer, or they can update the software provided on the cd-rom with new software via the remote computer.

Figure 3:
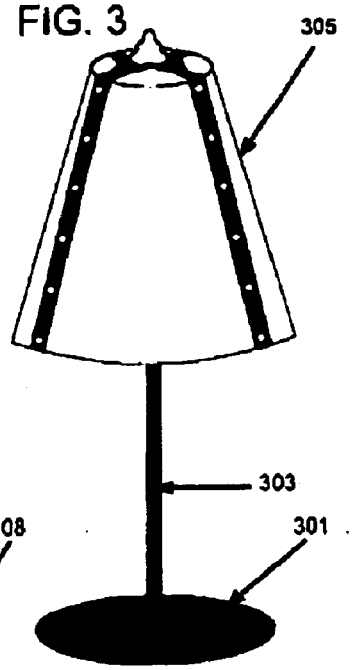
FIG. 3 depicts an assembled lamp shade on a lamp.

FIG. 3 shows lamp base 301 with a stand 303 on top of which is connected a completely assembled lamp shade 305. The base is preferably made of metal or plastic and the stand is preferably made of metal or plastic. Preferaly the base and stand screw together so the entire lamp can be packed flat.

Figure 4:
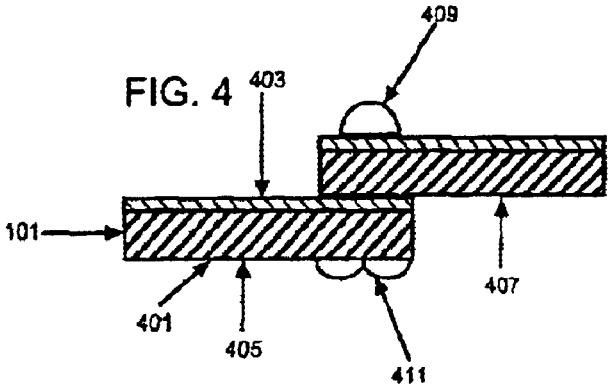
FIG. 4 is a cross-section through line 4—4 in FIG. 2.

FIG. 4 is a cross section taken along line 4—4 in FIG. 2 and shows a plastic panel 401 on top of which is adhered a label 403. Panels 405 and 407 are placed in overlapping relationship with corresponding holes registered, and a fastener 409 having prongs 411 is inserted into the hole and the prongs splayed out to secure the panels to each other.

Figure 6:
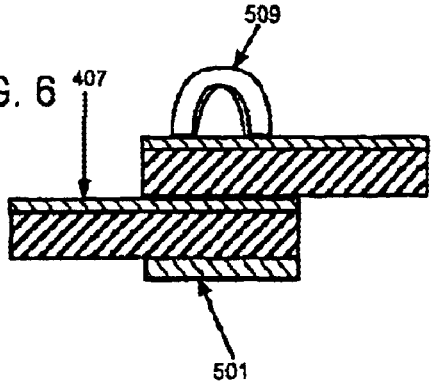
FIG. 6 is a cross-section through line 4—4 in FIG. 2 wherein the fasteners are the strip as shown in FIG. 5.

As noted above, FIG. 5 provides a strip of removable fasteners. FIG. 6 is a cross-sectional view as FIG. 4, but where the fasteners are the strip shown In FIG. 5. Of course, the spacing of the fasteners on the strip 501 should register with the holes 107 in each of the panels. Although not as preferred, the panels can be attached instead, or additionally, though the use of an adhesive or other mechanical fasteners (e.g., hook and loop type such as VELCRO brand) running along the line of holes 107. Still further, instead of discrete fasteners, a thong (leather), synthetic cord, wire, or fine chain can be used and threaded through the holes to secure the panels together; in this case, the panels can be held with small mechanical fasteners at a few points with the material threaded through the holes.

When the user desires, the shade is removed from the lamp and the fasteners are removed to break down the shade into its components. A new pattern or design can then be printed on a new set of labels, either designed locally or downloaded from the website, or delivered from ones selected or created on the website. The old label can be removed from the panel and the new label adhered in its place. New labels, and/or preprinted or blank panels can be delivered via the website. The panels and hanger, and if needed the labels, are then reassembled and the lamp shade is replaced on the lamp with a new design.

Figure 7A:
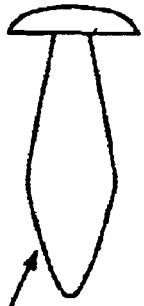
FIGS. 7A and 7B depict a plastic fastener (7A) and a cross-section similar to FIG. 4 (7B) using such a fastener.
Figure 7B:
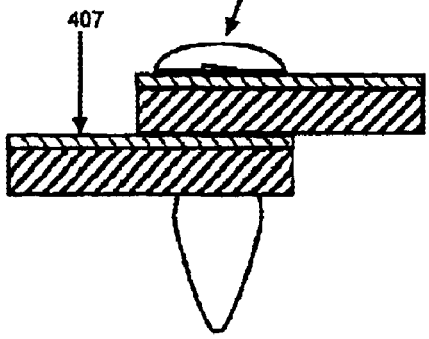

FIG. 7A depicts a plastic fastener 701 having a top and an oblong, triangular base, which can be pushed through the holes in the panels, resulting in the cross-section shown in FIG. 7B.

Figure 8:
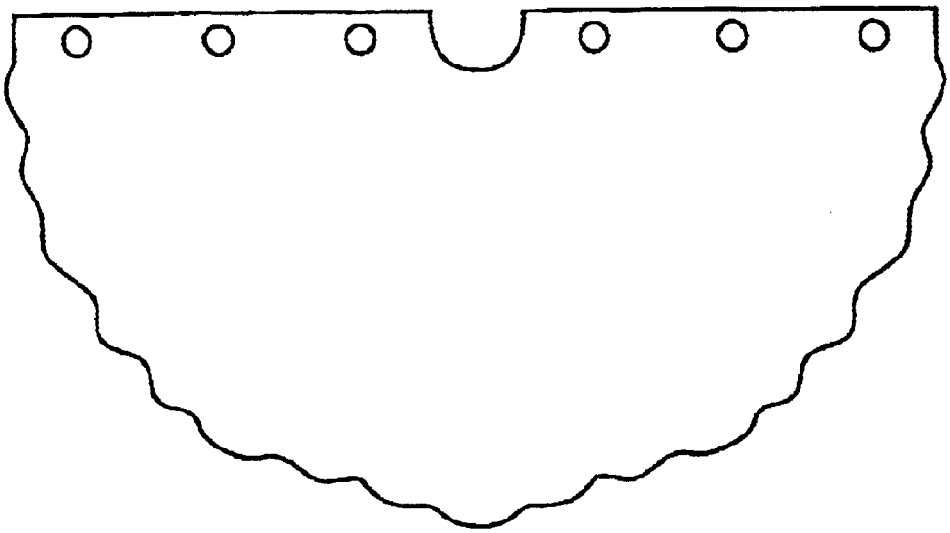
FIG. 8 depicts a single, hemispherical panel.

FIG. 8 shows a hemispherical panel that is curved into a single lamp shade. Preferably, such lamps are provides as a series of string lights, as shown in FIG. 9. The light string can be of the type commonly used for holiday or Christmas decorations, a electrical wire (or twisted pair, insulated) having located at relatively equal spacing therealong a lamp. The shade is appropriately sized for the lamp, being smaller than one would typically use for a table lamp. Depending on the size of the lamp, the shade could be petite, having a height of about three inches (about 7 cm), of medium size (about 5 inches, or about 12 cm), or larger as desired. The hanger 108 can be adapted to attach to the insulated wire or to the base of the lamp.

Figure 11:
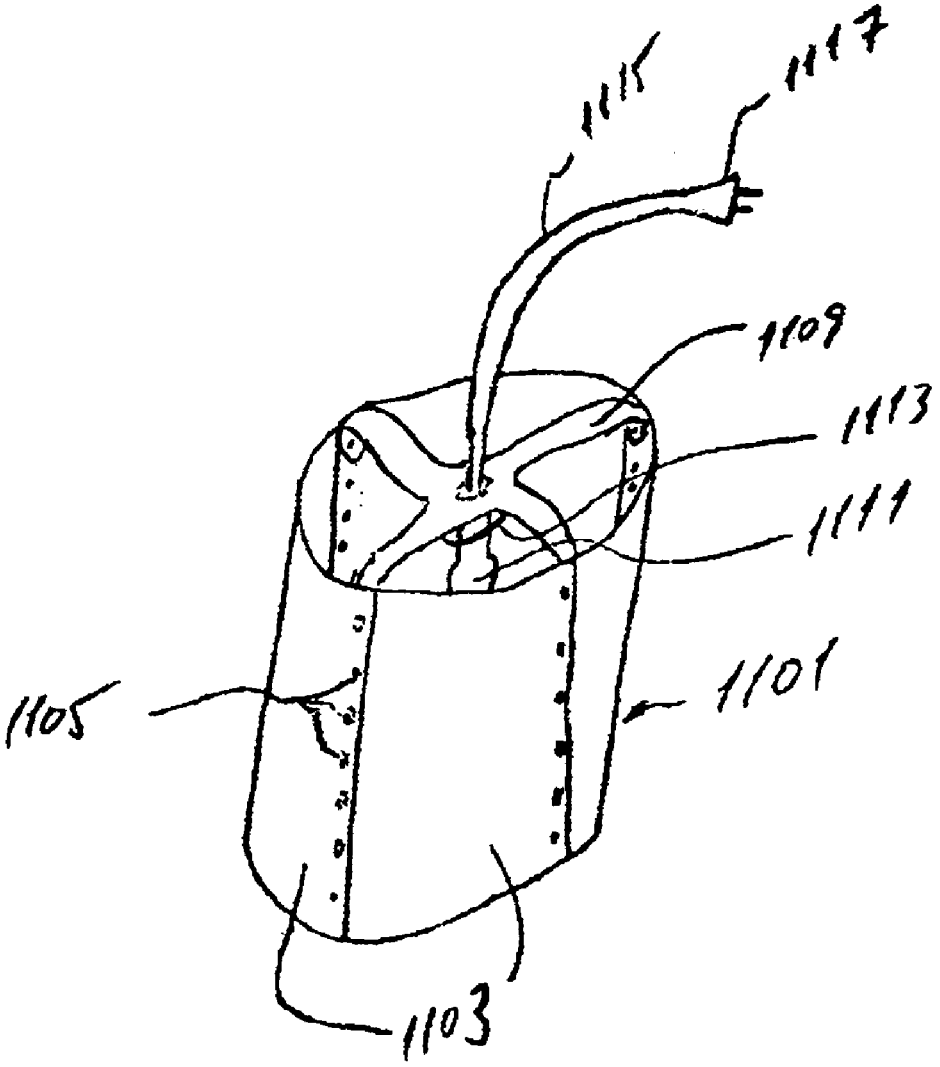
FIG. 11 depicts a pendant (hanging) lamp that can be flat-packed.

FIG. 11 depicts a pendant lamp 1101 having the same type of panels 1103 as discussed above, held together by connectors 1105 when the holes along the sides are registered. As with the table lamp, there is a hanger 1109 with arms, the end of each arm having a hole that can be registered with a hole in the panel, and is so held by the same connector joining two panels. A bulb 1111 is held in a receptacle 1113 on which the hanger rests, and has an electrical cord 1115, extending through a hole in the hanger, with a connecting plug 1117 is used to provide electricity.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A lamp shade comprising:

a plurality of panels, each panel having a top edge, a bottom edge, and opposing side edges, each side edge having a plurality of holes adjacent each side edge;

fastener means releaseably securing two panels in adjacent and overlapping relationship along their corresponding side edges; and means for mounting said plurality of panels on a lamp when the panels are assembled together by bringing adjacent panels into overlapping relationship whereby corresponding holes of adjacent panels register, and the fastener fits through the registered holes.

2. The lamp shade of claim 1, wherein the fastener means are metal prong fasteners.

3. The lamp shade of claim 1, wherein the fastener means are transparent plastic, translucent plastic, colored transparent plastic, or colored translucent plastic.

4. The lamp shade of claim 1, wherein the fastener means are selected from thongs, cords, wires, and chains.

5. The lamp shade of claim 1, further comprising a label adhered to at least one of the panels, said label having essentially the same geometry as the panel to which it is adhered.

6. The lamp shade of claim 1, wherein the panels are made from at least one of plastic, metal, and paperboard.

7. The lamp shade of claim 5, wherein each panel has a label adhered to it.

8. The lamp shade of claim 1, wherein each panel has a pattern pre-printed thereon.

9. The lamp shade of claim 1, wherein the fastening means comprises a strip of fasteners.

10. A kit for making a lamp shade, comprising:

a plurality of panels, each panel having a top edge, a bottom edge, and opposing side edges, each side edge having a plurality of holes adjacent each side edge;

a set of fasteners releaseably securing two panels adjacent and overlapping along their corresponding side edges when corresponding holes of the adjacent overlapping panels register;

means for mounting said plurality of panels on a lamp when the panels are assembled together adjacently; and at least one of (i) a plurality of pre-printed labels or (ii) a combination of blank labels and software able to be run on a personal computer for printing a pattern or design on the blank labels, each of said labels having essentially the same geometry as the panel to which it is adhered.

11. The kit of claim 10, further comprising instructions selected from the group consisting of instructions for assembling the lamp shade, and instructions for using the software for printing on the blank labels, and a combination thereof.

12. The kit of claim 10, wherein each fastener is insertable through corresponding registered holes in overlapping adjacent edges of the panels.

13. The kit of claim 10, wherein the fasteners are selected from thongs, cords, wires, and chains.

14. The kit of claim 10, further comprising a base and a stand.

15. The kit of claim 14, wherein the base and stand screw together.

16. The kit of claim 15, wherein the lampshade kit, base, and stand are flat-packed together in a single package.

17. A method for making a lampshade, comprising:

providing a plurality of panels having holes along edges where one panel meets another;

decorating at least one of said panels by means of (i) applying a pre-made label to the panel, (ii) creating and printing a label and then applying the label to the panel, (iii) providing a panel having a decoration printed thereon;

joining said panels in adjacent relationship to create a shade by overlapping said holes along adjacent edges and providing fasteners through said overlapping holes; and affixing a hanger to said shade to create a lamp shade.

18. The method of claim 17, wherein at least one panels is made front plastic, metal, or paperboard.

19. The method of claim 17, wherein the step of creating the label is done via a website.

20. The method of claim 17, wherein the step of providing a panel having decoration printed thereon is done by ordering said panel through a website.

21. A self-supporting lampshade lacking a frame, comprising:

at least one panel having a top edge, a bottom edge, and two side edges;

each of the side edges of a panel having a plurality of holes spaced along each edge;

separate edges placed in overlapping relationship effective to register hales in one edge with corresponding holes in the other edge; and a fastener through each of the corresponding registered holes, whereby the fastened panel is self-supporting as a lampshade without a separate frame.

22. A lighting display, comprising: an electrical wire having a series of lamps disposed along its length, each lamp having associated therewith a lamp shade comprising; a panel having a top edge, a bottom edge, and opposing side edges, each side edge having a plurality of holes adjacent each side edge, and each of said panels being self-supporting, sufficiently flexible to be releasably secured in a curved form and to be packed in a flat configuration; and fastener means releasably securing overlapping side edges to each other when the holes are registered.

23. A lighting display, comprising an electrical wire having a series of lamps disposed along its length, each lamp having associated therewith a lamp shade consisting essentially of: a panel having a top edge, a bottom edge, and opposing side edges, each side edge having a plurality of holes adjacent each side edge, and each of said panels being self-supporting, sufficiently flexible to be releasably secured in a curved form and to be packed in a flat configuration; and fastener means releasably securing overlapping side edges to each other when the holes are registered, said panel being associated with each lamp by the curvature at the top surface of the panel being appropriately sized for the particular lamp size when secured and being secured to the lamp without the use of a hanger.

24. The display of claim 22, wherein the panels and the fastener means are flat-packed together, separate from the electrical wire with lamps.

* * * * *